US009068521B2

(12) United States Patent
Naegele et al.

(10) Patent No.: US 9,068,521 B2
(45) Date of Patent: Jun. 30, 2015

(54) METHOD FOR OPERATING AN INTERNAL COMBUSTION ENGINE

(71) Applicants: Claus Naegele, Stuttgart (DE); Andreas Paa, Winnenden (DE); Clemens Klatt, Winnenden (DE); Christoph Widmann, Bad Urach-Sirchingen (DE)

(72) Inventors: Claus Naegele, Stuttgart (DE); Andreas Paa, Winnenden (DE); Clemens Klatt, Winnenden (DE); Christoph Widmann, Bad Urach-Sirchingen (DE)

(73) Assignee: ANDREAS STIHL AG & CO. KG, Waiblingen (DE)

( * ) Notice: Subject to any disclaimer, the term of this patent is extended or adjusted under 35 U.S.C. 154(b) by 68 days.

(21) Appl. No.: 13/721,465

(22) Filed: Dec. 20, 2012

(65) Prior Publication Data

US 2013/0160751 A1 Jun. 27, 2013

(30) Foreign Application Priority Data

Dec. 22, 2011 (DE) ..... 10 2011 122 125

(51) Int. Cl.
*F02D 41/00* (2006.01)
*F02D 41/18* (2006.01)
*F02B 63/02* (2006.01)

(52) U.S. Cl.
CPC ..... *F02D 41/00* (2013.01); *F02D 41/18* (2013.01); *F02B 63/02* (2013.01); *F02D 2200/704* (2013.01)

(58) Field of Classification Search
CPC ..... F02D 41/00; F02D 41/18; F02D 11/08; F02B 63/02
USPC ..... 123/572, 196 CP; 700/301; 73/25.04, 73/118.01, 118.02
See application file for complete search history.

(56) References Cited

U.S. PATENT DOCUMENTS 4,920,790 A * 5/1990 Stiles et al. ..... 73/114.32
4,958,516 A * 9/1990 Stiles et al. ..... 73/114.32
(Continued)

FOREIGN PATENT DOCUMENTS

DE 10 2005 046 782 A1 4/2007
DE 10 2006 060 617 A1 7/2007
DE 10 2008 019 088 A1 11/2008

OTHER PUBLICATIONS

European Search Report, Appl. No. 12008365.4-1606, Apr. 25, 2013, 4 pgs.
(Continued)

*Primary Examiner* — Lindsay Low
*Assistant Examiner* — Grant Moubry
(74) *Attorney, Agent, or Firm* — Paul D. Strain, Esq.; Strain & Strain PLLC

(57) ABSTRACT

An internal combustion engine has a cylinder in which a combustion chamber, bounded on one side by a reciprocating piston, is formed. The piston drives a crankshaft rotatably mounted in a crank casing. The internal combustion engine has an inlet opening for combustion air into the crank casing, and an outlet opening out of the combustion chamber. The internal combustion engine has at least one overflow duct which connects the crank casing interior to the combustion chamber. The internal combustion engine has a crank casing pressure sensor for measuring the crank casing pressure, a device for determining the rotational position of the crankshaft, and an evaluation device which evaluates the measurements of the crank casing pressure sensor. A method for operating the internal combustion engine is provided where the ambient pressure is determined using the crank casing pressure measured by the crank casing pressure sensor.

14 Claims, 4 Drawing Sheets

(56) References Cited

U.S. PATENT DOCUMENTS

| | | | | |
|---|---|---|---|---|
| 5,257,607 | A * | 11/1993 | Gillespie | 123/478 |
| 5,404,843 | A | 4/1995 | Kato | |
| 5,586,524 | A | 12/1996 | Nonaka et al. | |
| 5,669,358 | A * | 9/1997 | Osakabe | 123/509 |
| 7,536,983 | B2 | 5/2009 | Layher et al. | |
| 7,814,888 | B2 | 10/2010 | Roβ kamp et al. | |
| 2007/0163557 | A1 | 7/2007 | Layher et al. | |
| 2008/0264388 | A1 | 10/2008 | Rosskamp et al. | |

OTHER PUBLICATIONS

European Office Action, Appl. No. 12008365.4-1606, Sep. 25, 2014, 5 pgs.

* cited by examiner

METHOD FOR OPERATING AN INTERNAL COMBUSTION ENGINE

CROSS-REFERENCE TO RELATED PATENT APPLICATIONS

This application is based upon and claims the benefit of priority from prior German Patent Application No. DE 10 2011 122 125.9, filed Dec. 22, 2011, the entire contents of which are incorporated herein by reference in their entirety.

BACKGROUND

The application relates to an internal combustion engine and a method for operation thereof. An exemplary embodiment of the method involves providing a crank casing pressure sensor in an internal combustion engine, measuring a crank casing pressure using the crank casing pressure sensor, evaluating the crank casing pressure measurements, and controlling the internal combustion engine, a component thereof, or a device attached to the internal combustion engine using crank casing pressure measurements. An exemplary embodiment of the internal combustion engine has a crank casing having the crank casing pressure, a combustion chamber bounded on one side and around a circumference by a cylinder and bounded on the other side by a reciprocating piston, a crankshaft driven by the reciprocating piston which is rotatably mounted in the crank casing, an inlet opening in the crank casing which allows combustion air to enter into the crank casing, an outlet opening out of the combustion chamber, one or more overflow ducts connecting the crank casing to the combustion chamber in the region of the bottom dead center of the piston, and a sensor to detect the rotational position of the crankshaft.

In internal combustion engines, for example in two-stroke engines, a pressure sensor in the crank casing may, during operation, supply data used to control the internal combustion engine, for example to control the fed-in quantity of fuel, to control the injection time, or to control the ignition time. DE 10 2008 019 088 A1 presents an internal combustion engine. Therein, the pressure sensor in the crank casing is used to determine at what times the metering valve, which feeds the fuel into the crank casing, is opened and closed.

U.S. Pat. No. 7,536,983 B2 discloses a two-stroke engine having a pressure sensor which determines the crank casing pressure. The crank casing pressure is used during operation therein to determine the air mass flow through the combustion chamber, and to determine therefrom the quantity of fuel to be fed in.

Internal combustion engines, for example internal combustion engines in hand-guided tools, may be used at different altitudes. Differences in altitude result in changes in the ambient pressure. The different pressure level of the ambient pressure has to be taken into account in the actuation of the internal combustion engine, in particular in the determination of the quantity of fuel which is to be fed in. In many devices this is done by means of corresponding adjustment screws on a carburetor of the internal combustion engine, which are to be adjusted by the user.

SUMMARY OF PREFERRED EMBODIMENTS

It is therefore one object of the application to provide a method for operating an internal combustion engine in a hand-guided tool, which method enables the ambient pressure to be determined without additional sensors. An exemplary embodiment of the method involves providing a crank casing pressure sensor in an internal combustion engine, measuring a crank casing pressure using the crank casing pressure sensor, evaluating the crank casing pressure measurements, and controlling the internal combustion engine, a component thereof, or a device attached to the internal combustion engine using crank casing pressure measurements. An exemplary embodiment of the internal combustion engine has a crank casing having the crank casing pressure, a combustion chamber bounded on one side and around a circumference by a cylinder and bounded on the other side by a reciprocating piston, a crankshaft driven by the reciprocating piston which is rotatably mounted in the crank casing, an inlet opening in the crank casing which allows combustion air to enter into the crank casing, an outlet opening out of the combustion chamber, one or more overflow ducts connecting the crank casing to the combustion chamber in the region of the bottom dead center of the piston, and a sensor to detect the rotational position of the crankshaft.

In another embodiment, it is provided to use the crank casing pressure sensor, which may already be present, to determine the ambient pressure. As a result, an additional sensor for determining the ambient pressure may not be required in such an embodiment. In another embodiment, the ambient pressure may be determined from one or more pressure values which may be measured by means of the crank casing pressure sensor.

In yet another embodiment, the crank casing pressure is advantageously measured at a time at which approximately ambient pressure prevails in the crank casing. As a result, the ambient pressure is measured directly as the pressure value. Accordingly, it may be possible to dispense with additional steps for determining the ambient pressure from the measured pressure value.

In a further embodiment, the crank casing pressure is advantageously measured during the starting process of the internal combustion engine, before the first combustion event as the crankshaft is rotating. In this embodiment, it is provided that the crank casing pressure sensor is supplied with energy exclusively via the crankshaft during the measurement. As a result, there is no need for a separate energy storage means such as, by way of example, a battery or an accumulator, which makes energy available for the crank casing pressure sensor before the internal combustion engine starts. In another embodiment, the crank casing pressure sensor and the evaluation device are supplied with energy exclusively via the movement of the crankshaft. In this embodiment, a pressure measurement before the start of the starting process, that is to say before the crankshaft starts to rotate, may not be possible because before the start of the starting process there is no energy available to measure the pressure. Yet, once combustion has taken place in the combustion chamber, the pressure level in the combustion chamber changes and the pressure level in the crank casing also changes via the overflow ducts. Therefore, the pressure value is measured during the starting process but before the first combustion to ensure that the pressure level has not yet changed due to combustion that has already taken place. In another embodiment, the pressure measurement advantageously takes place here as soon as the crank casing pressure sensor is supplied with sufficient energy for the measurement.

In yet a further embodiment, the crank casing is connected to the surroundings in a first crankshaft angle range if the inlet opening is closed and the crank casing is connected to the combustion chamber via at least one overflow duct and if the outlet opening is opened. The crank casing is connected to the surroundings via the overflow ducts, the combustion chamber and the outflow opening. As a result, a pressure, from which the ambient pressure can be determined, occurs in the crank casing. The crank casing pressure, from which the ambient pressure is determined, is measured, in particular, in a first crankshaft angle range. The ambient pressure in the crank casing advantageously occurs at least in part of the first crankshaft angle range. However, owing to throttle points in the flow path, a pressure value which deviates from the ambient pressure can also occur in the crank casing. The ambient pressure can be determined from the measured pressure value, for example by calculation.

In another embodiment, in a second crankshaft angle range, the crank casing is open to the surroundings via the inlet opening into the crank casing. In yet another embodiment, it is also possible to provide that the measurement of the crank casing pressure, from which the ambient pressure is determined, takes place in the second crankshaft angle range. In the crank casing, a pressure from which the ambient pressure can be determined also occurs in this crankshaft angle range.

In a further embodiment, the internal combustion engine advantageously has an air filter through which the combustion air is sucked in. In one embodiment, the degree of contamination of the air filter may be determined from one or more values determined for the ambient pressure. In another embodiment, it may also be possible to determine whether an air filter is present or, for example, has been forgotten by the operator. In yet another embodiment, in order to determine the degree of contamination of the air filter it is advantageously provided that the crank casing pressure is also determined at full load of the internal combustion engine. In a further embodiment, the degree of contamination of the air filter is advantageously determined from the ambient pressure, determined, in particular, during the starting process, and the crank casing pressure at full load.

In another embodiment, the degree of contamination of the air filter may be determined, for example, from the ratio of the ambient pressure to the crank casing pressure at full load or from the difference between the ambient pressure and the crank casing pressure at full load.

In a further embodiment, another way of determining the degree of contamination of the air filter from the two specified pressure values may also be advantageous. It is also possible to provide for the degree of contamination of the air filter to be determined by means of a single pressure measurement. During the starting process and also during idling the flow speeds in the intake section are still comparatively low. The degree of contamination of the air filter does not have a significant effect on the crank casing pressure in these operating states. At full load, the contamination of the air filter brings about additional throttling of the air path, which has a significant effect on the crank casing pressure which occurs. The ratio of the ambient pressure to the crank casing pressure at full load therefore permits conclusions to be drawn about the degree of contamination of the air filter. It is also possible to provide for a different pressure value, measured during the starting process or during the idling at the crank casing pressure, to be used to determine the degree of contamination of the air filter. The pressure measurements in the crank casing take place here at specific crankshaft angles. In one embodiment, therefore, during the evaluation of the pressure ratio, the crankshaft angle at which the pressure measurement takes place in the crank casing is taken into account. The pressure measurement during the starting process or during idling or both and the pressure measurement at full load advantageously take place at the same crankshaft angle. However, in another embodiment it may also be advantageous for the pressure measurements to take place at different crankshaft angles.

In yet another embodiment, the determination of the degree of contamination of the air filter advantageously takes place on the basis of a comparison of a setpoint volumetric efficiency with an actual volumetric efficiency of the internal combustion engine at full load. The volumetric efficiency of the internal combustion engine is measured by using the combustion air mass fed per unit of time to the internal combustion engine. The actual volumetric efficiency may be determined or represented, by way of example, as described in U.S. Pat. No. 7,536,983 B2, or by some other way as would be known by one of ordinary skill in the art, and may be determined from the pressure in the crank casing of the internal combustion engine. The setpoint volumetric efficiency can be determined, for example, by means of a stored characteristic curve. If the air filter is heavily contaminated, the actual volumetric efficiency of the internal combustion engine is significantly lower than the setpoint volumetric efficiency. The setpoint volumetric efficiency may depend on the altitude at which the internal combustion engine is operated. The setpoint volumetric efficiency may also depend on the ambient temperature. In a further embodiment, the altitude or the ambient temperature or both may advantageously be taken into account in the determination of the setpoint volumetric efficiency. The influence of the altitude and ambient temperature may advantageously be partially or completely compensated for.

In yet another embodiment, the degree of contamination may be indicated to the operator using, by way of example, a visual display. The operator or servicing technician may also be informed about the degree of contamination by a corresponding entry in a diagnostic memory or when the diagnostic memory of the tool is read out. It is also possible to provide for the operator to be given feedback about the degree of contamination of the air filter by altering the behavior of the internal combustion engine, for example by reducing the power in the internal combustion engine, by switching off the internal combustion engine, or by other methods of altering the behavior known by one of ordinary skill in the art. It is also possible to provide for the determined state of the air filter to be output in a diagnostic device during the maintenance of the tool and for the service technician to be requested to check the air filter.

In another embodiment, the internal combustion engine advantageously has a generator for generating energy. The crank casing pressure sensor advantageously measures the crank casing pressure at each zero crossing of the generator signal. The measured pressure values are advantageously buffered, for example in the evaluation device of the internal combustion engine or in other devices known by one of ordinary skill in the art. The approximate rotational position of the crankshaft may advantageously be determined and a measured value, which has been measured in the desired crankshaft angle range, may be selected from the buffered pressure values on the basis of the determined rotational position of the crankshaft. As a result, the first measurement can take place immediately when sufficient energy is available for the pressure measurement. Accordingly, it is not necessary to wait until for the rotational position of the crankshaft to be determined to measure pressure. Instead, the pressure may be measured immediately, after which the desired crankshaft angle range is determined retroactively on the basis of the determined rotational position of the crankshaft. Because usually only one revolution or a few revolutions of the crankshaft are available for the pressure measurement until the first combustion occurs, the pressure measurement must be started as early as possible.

In yet another embodiment, the approximate position of the crankshaft is advantageously determined by means of a crankshaft sensor or from the signal of the generator. The determination of an approximate rotational position of the crankshaft may be sufficient for the determination of the ambient pressure from the crank casing pressure. However, it is also possible in a further embodiment to provide for the rotational position of the crankshaft to be determined as precisely as possible. This is advantageous, in particular, if knowledge of the precise rotational position of the crankshaft is required to control the internal combustion engine.

In a further embodiment of the application the internal combustion engine contains a crank casing having a crank casing pressure, a pressure sensor which measures the crank casing pressure, an evaluation device which evaluates the crank casing pressure measurements, a memory buffer, and a controller device, which uses information from the evaluation device or the memory buffer or both to control the internal combustion engine, a component thereof, or a device attached to the internal combustion engine, where the evaluation device, memory buffer, and controller device are advantageously located in the same device but may also be contained in distinct devices.

Another embodiment includes an internal combustion engine which contains a crankshaft driven by the reciprocating piston which is rotatably mounted in the crank casing, a generator for generating energy, and a second sensor for measuring an angle of rotation of a crankshaft or the voltage of the generator or both, where the evaluation device as mentioned above further evaluates the measurements of the second sensor. The control device then controls the internal combustion engine, a component thereof, or a device attached to the internal combustion engine using these measurements.

Yet another embodiment of the present application relates to an internal combustion engine wherein the crank casing pressure is measured at a time at which approximately ambient pressure prevails in the crank casing. A further embodiment provides that the crank casing pressure is determined from the ambient pressure which is measure during the starting process of the internal combustion engine before the first combustion as the crankshaft is rotating.

An additional embodiment contains an air filter through which combustion air is sucked in, and the degree of contamination of the air filter may be determined from at least one measured value from the pressure sensor. Yet a further embodiment provides that the evaluation device determines one or more of the following using one or more measurements from the pressure sensor or the second sensor or both: the ambient pressure, the altitude, the contamination of the air filter, and the volumetric efficiency of the internal combustion engine.

In another embodiment, a hand-guided tool contains an internal combustion having the aspects of any of the embodiments, claims, or their equivalents.

Further objects, features, and advantages of the present application will become apparent form the detailed description of preferred embodiments which is set forth below, when considered together with the figures of drawing.

BRIEF DESCRIPTION OF THE DRAWINGS

Several exemplary embodiments of the application are explained below with reference to the drawings, in which.

DETAILED DESCRIPTION OF PREFERRED EMBODIMENTS

Figure 1:
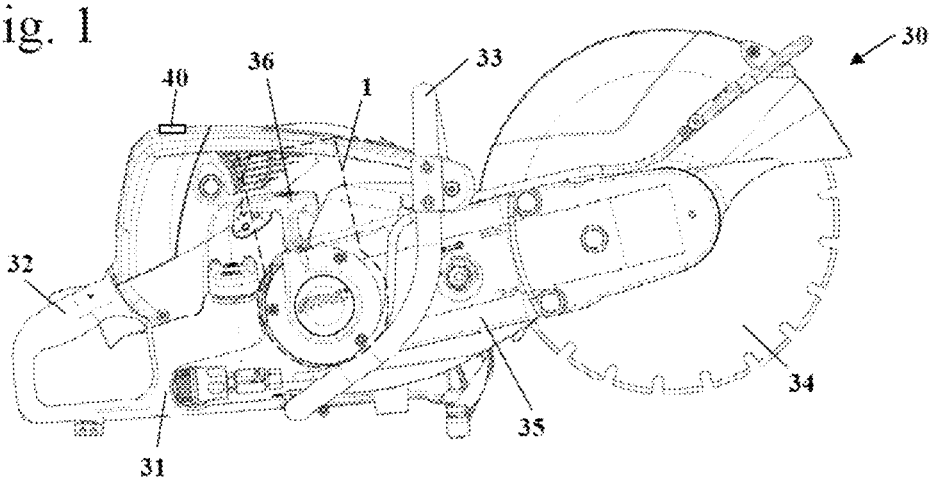
FIG. 1 shows a side view of a cut-off grinder.

Turning to the figures of drawing, FIG. 1 shows a cut-off grinder 30 as one exemplary embodiment of a hand-guided tool. Instead of in a cut-off grinder 30, the internal combustion engine 1 described in more detail below can also be used in other applications such as, by means of example and without limitation, motorized saws, brushcutters, or other devices containing internal combustion engines.

The cut-off grinder 30 has a housing 31 to which a rear handle 32 and a gripping tube 33 for guiding the cut-off grinder 30 during operation are secured. An extension arm 35 is secured to the housing 31 and projects forward and has a cutting disc 34 rotatably mounted on its free end. The cutting disc 34 is driven in rotation by the internal combustion engine 1 arranged in the housing 31. The internal combustion engine 1 is embodied as a two-stroke engine in this exemplary embodiment. However, the internal combustion engine 1 may also be a mixed lubrication four-stroke engine or another appropriate internal combustion engine as would be recognized by one of ordinary skill in the art. In order to start the internal combustion engine 1 a hand-activated starter device is used in the exemplary embodiment, which starter device can be operated by means of a starter grip 36. The starter device is embodied as a cable-type starter device. A display 40 is provided on the housing 31 and is used to display the degree of contamination of an air filter of the internal combustion engine 1. The display 40 may be, for example, a display or a light-emitting implement, for example an LED. In addition to, or as an alternative to, the optical display, the display 40 can also indicate the filter state acoustically. The cut-off grinder 30 advantageously has a diagnostic memory, for example in a control device of the cut-off grinder 30. The degree of contamination of the air filter can be stored in the diagnostic memory and read out by a service technician during later maintenance. It is also possible to provide for the operator to be informed about the entry in the diagnostic memory relating to the degree of contamination of the air filter.

Figure 2:
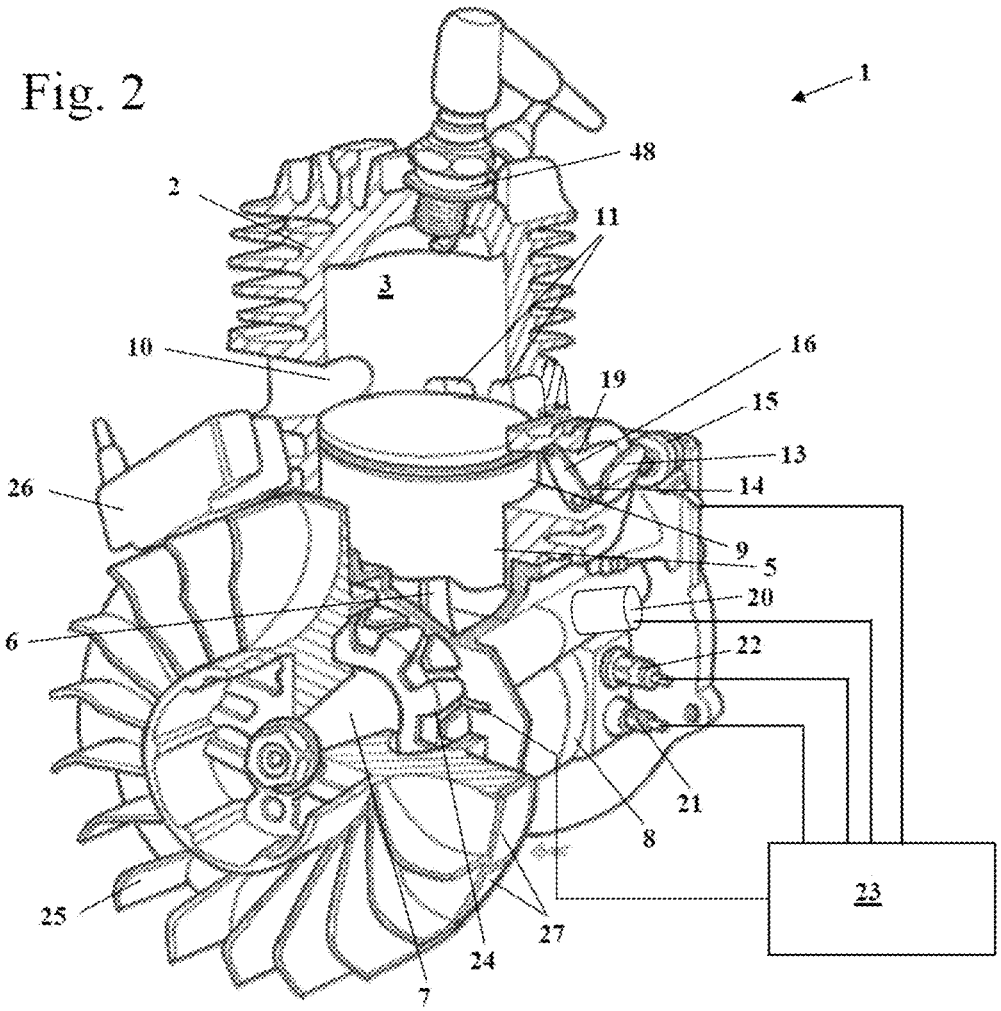
FIG. 2 shows a perspective, partially sectional illustration of the internal combustion engine from FIG. 1.

FIG. 2 shows the exemplary internal combustion engine of FIG. 1 in greater detail. The internal combustion engine 1 has a cylinder 2 which bounds a combustion chamber 3 on one side and around the circumference of combustion chamber 3. The combustion chamber 3 is further bounded on the other side by a piston 5 which moves in a reciprocating fashion in the cylinder 2 and is shown at its bottom dead center in FIG. 2. The piston 5 drives, via a connecting rod 6, a crankshaft 7 which is rotatably mounted in a crank casing 8. A generator 24, which generates energy as a function of the rotational movement of the crankshaft 7, is secured to the crankshaft 7. Furthermore, an impeller wheel 25, which serves to deliver cooling air, is secured to the crankshaft 7. The impeller wheel 25 has, on its outer circumference, magnets 27 which generate the ignition voltage for a spark plug 48 projecting into the combustion chamber 3, in an ignition module 26 arranged on the outer circumference of the impeller wheel 25. A crank casing pressure sensor 21 and a temperature sensor 22, which measure pressure and temperature in the crank casing 8, are arranged on the crank casing 8. The crank casing pressure sensor 21 and the temperature sensor 22 are advantageously arranged in a common housing. The crank casing pressure sensor 21 and the temperature sensor 22 can also be integrated in a single sensor. Furthermore, a fuel valve 20, which feeds fuel into the interior 4 of the crank casing (FIG. 3), is also arranged on the crank casing 8. The ignition module 26, the generator 24, the crank casing pressure sensor 21, the temperature sensor 22 and the fuel valve 20 are connected to an evaluation device 23. The evaluation device 23 is at the same time the control device of the internal combustion engine 1.

In order to feed in combustion air, the two-stroke engine 1 has an intake duct 19 which opens with an inlet opening 9 into the interior 4 of the crank casing. The inlet opening 9 is piston-ported by the piston 5. A throttle valve 13 having a throttle shaft 14 is pivotably mounted in the intake duct 19. The position of the throttle valve 13 is set by means of a throttle lever 16 by a hand throttle 49 (FIG. 1), actuated by the operator, of the cut-off grinder 30. The position of the throttle shaft 14 is monitored by a throttle sensor 15, which is also connected to the evaluation device 23. At the bottom dead center of the piston 5, the interior 4 of the crank casing is connected to the combustion chamber 3 via overflow ducts 11.

Figure 3:
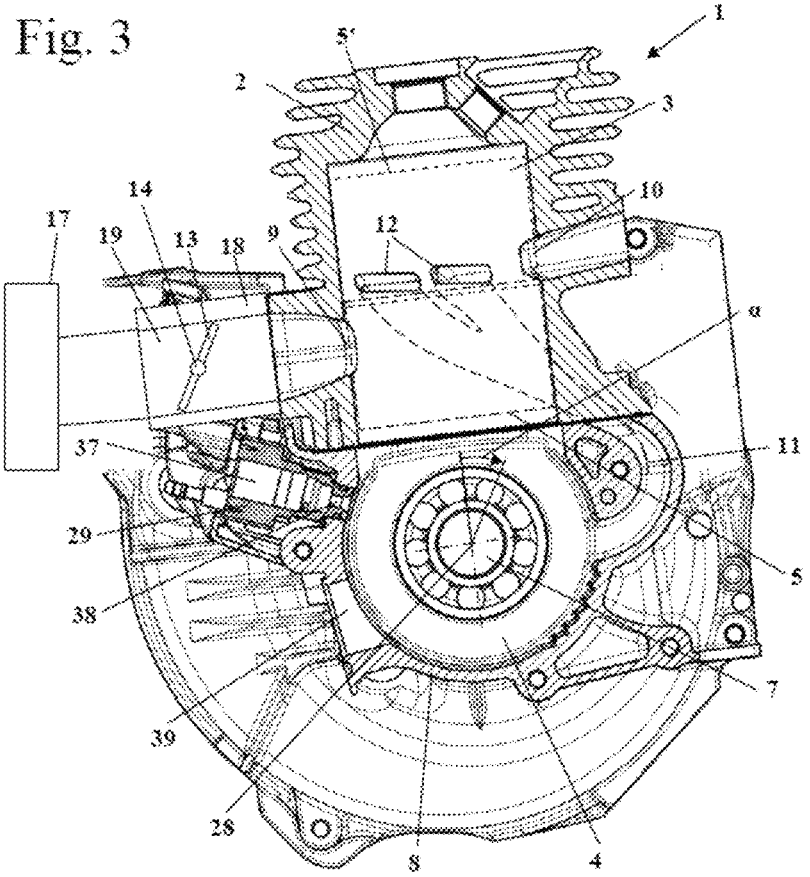
FIG. 3 shows a section through the internal combustion engine from FIG. 2.

FIG. 3 shows the design of the internal combustion engine 1 in particular. There is an overflow duct 11 which divides into a plurality of branches and opens into the combustion chamber 3 with a plurality of overflow windows 12. Pre-compressed fuel/air mixture flows into the combustion chamber 3 from the interior 4 of the crank casing via the overflow duct 11. The crankshaft 7 can rotate about a rotational axis 28. The rotational position of the crankshaft 7 about the rotational axis 28 is measured with a crankshaft angle $\alpha$. At the top dead center of the piston 5, the crankshaft angle $\alpha$ corresponds to an angle of 0°. At the bottom dead center of the piston 5, the interior 4 of the crank casing is connected to the combustion chamber 3 via the overflow duct 11. An outlet opening 10, which is piston-ported by the piston 5, leads out of the combustion chamber 3. At the bottom dead center, the outlet opening 10 is opened by the piston 5. The crankshaft angle $\alpha$ is 180°. The top dead center of the piston is indicated in FIG. 3 by a piston 5'. In this piston position, the outlet opening 10 is closed and the overflow windows 12 are also closed by the piston 5'. The inlet opening 9 into the interior 4 of the crank casing is opened, with the result that the interior 4 of the crank casing is connected to the surroundings via the inlet opening 9. As is shown by FIG. 3, the internal combustion air is sucked into the intake duct 19 via an air filter 17. The filter material of the air filter 17 disconnects the interior 4 of the crank casing from the surroundings. Likewise, the throttle valve 13 can constitute a throttle point. The throttle valve 13 is mounted in a throttle casing 18 which is secured to the inlet connector of the cylinder 2.

As is also shown by FIG. 3, the crank casing 8 has a mounting opening 39 in which the crank casing pressure sensor 21 (FIG. 2) and the temperature sensor 22 (FIG. 2) are arranged. Furthermore, a mount 29 is arranged on the crank casing 8 and has a receptacle 37 for the fuel valve 20 (FIG. 2). Fuel from the fuel valve 37 flows into the interior 4 of the crank casing via a connecting duct 38 which is formed in the mount 29.

During operation, in the region of the top dead center of the piston 5 combustion air is sucked into the interior 4 of the crank casing via the inlet opening 9. Fuel is metered into the combustion air via the fuel valve 20 (FIG. 2). During the downward stroke of the piston 5, the fuel/air mixture is compressed in the interior 4 of the crank casing. As soon as the overflow windows 12 are opened by the piston 5 during the downward stroke of the piston 5, the pre-compressed mixture flows out of the interior 4 of the crank casing via the overflow duct 11 and into the combustion chamber 3. There, the mixture is compressed during the following upward movement of the piston 5 and is fired by the spark plug 48 (FIG. 2) in the region of the top dead center of the piston 5. If combustion takes place in the combustion chamber 3, the piston 5 is accelerated in the direction of its bottom dead center. As soon as the piston 5 opens the outlet opening 10, the exhaust gases escape from the combustion chamber 3, in particular into an exhaust gas silencer arranged on the outlet opening 10.

Figure 4:
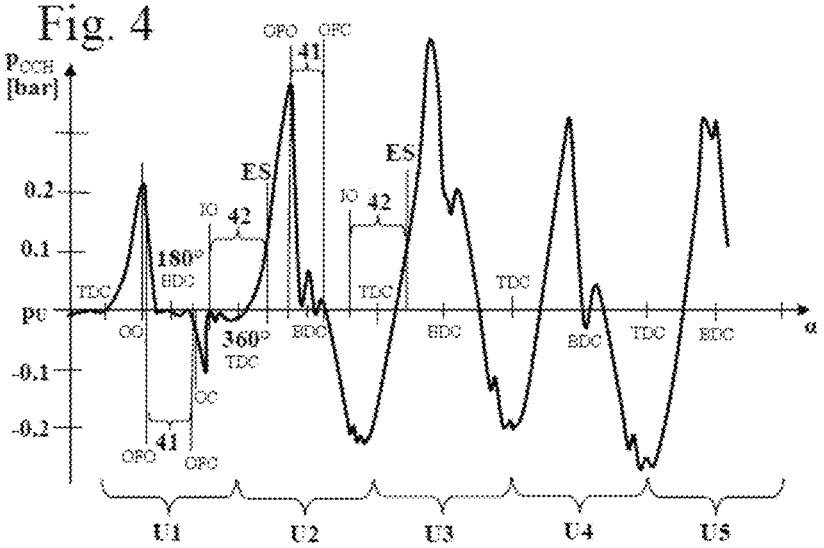
FIG. 4 shows an exemplary profile of the crank casing pressure during the first six revolutions of the crankshaft during the starting of an exemplary internal combustion engine.

FIG. 4 shows the profile of the crank casing pressure $p_{CCH}$ during the starting process. The crank casing pressure $p_{CCH}$ is shown here starting from the beginning of the movement of the crankshaft 7 on the basis of the operator pulling on the starter grip 36. The crank casing pressure $p_{CCH}$ is shown relative to the ambient pressure $p_U$ here. At the start of the starting stroke, the piston 5 is just before the top dead center. The crank casing pressure $p_{CCH}$ rises when the piston moves in the direction of the bottom dead center. Before the bottom dead center is reached, the outlet opening 10 firstly opens at the time 00. As soon as the outlet opening 10 opens, exhaust gas flows out of the combustion chamber 3. As soon as the overflow windows 12 open at the time OFO—that is to say just before the bottom dead center is reached—the crank casing pressure $p_{CCH}$ drops strongly at the first revolution U1 of the crankshaft 7 as far as approximately ambient pressure $p_U$, since the combustion air can flow out of the interior 4 of the crank casing into the combustion chamber 3. After the bottom dead center BDC, during the upward stroke of the piston 5 the overflow windows 12 are firstly closed at the time OFC, and shortly after this the outlet opening 10 is closed at the time OC. Shortly after this, the inlet opening 9 opens at the time IO. Since the piston 5 moves very slowly, only a small partial vacuum occurs in the interior 4 of the crank casing during the upward movement of the piston 5 until the top dead center TDC is reached. During the second revolution U2, during the upward stroke of the piston 5 an overpressure is firstly generated in the interior 4 of the crank casing, which overpressure drops strongly as soon as the overflow windows 12 open at the time OFO. The crank casing pressure $p_{CCH}$ drops approximately to ambient pressure $p_U$ when the overflow windows are opened. Between the opening and closing of the overflow windows 12 there is a crankshaft angle range 41 during which the interior 4 of the crank casing is connected to the surroundings via the overflow duct 11, the combustion chamber 3 and the outlet opening 10. The connection can be produced here via an exhaust gas silencer which is arranged at the outlet opening 10. Since the outlet opening 10 opens before the overflow windows 12 and closes after the overflow windows 12, the outlet opening 10 is always opened when the overflow windows 12 are opened. Virtually ambient pressure $p_U$ prevails in the region of the bottom dead center in the crankshaft angle range 41 in the crank casing. In this crankshaft angle range 41, the ambient pressure $p_U$ can be measured directly in the interior 4 of the crank casing.

After the bottom dead center is reached, the piston 5 generates an underpressure in the interior 4 of the crank casing as soon as the overflow windows 12 are closed and until the inlet opening 9 opens at the time IO, since the piston 5 is now moving sufficiently quickly. Every revolution starts and ends at the top dead center TDC here.

Between the bottom dead center BDC and the top dead center TDC the inlet opening 9 opens at the time IO, as is shown for the first revolution U1 in FIG. 4. After the top dead center, the inlet opening 9 closes at the time ES. In the crankshaft angle range 42, lying between the time 10 and the time ES, the interior 4 of the crank casing is connected to the surroundings via the inlet opening 9 and the air filter 17. During this time period, approximately ambient pressure prevails in the interior 4 of the crank casing, in particular at a crankshaft angle between the top dead center TDC and the closing of the inlet opening 9 at the time ES. In this time period, the crank casing pressure $p_{CCH}$ measured by means of the crank casing pressure sensor 21 corresponds approximately to the ambient pressure $p_U$. A pressure value from which the ambient pressure $p_U$ is determined can also be measured in the second crankshaft angle range. In particular, the crank casing pressure $p_{CCH}$ is measured at a time at which ambient pressure $p_U$ prevails in the interior 4 of the crank casing, and the ambient pressure $p_U$ can therefore be measured directly.

FIG. 4 also shows a third revolution U3, a fourth revolution U4 and a fifth revolution U5 of the crankshaft 7. During the fourth revolution U4, combustion takes place in the combustion chamber 3 for the first time. As is shown by FIG. 4, owing to the combustion the pressure level in the interior 4 of the crank casing shifts very strongly. At the bottom dead center, there is no longer any ambient pressure $p_U$ during the following fifth revolution U5 but instead a significantly higher pressure. The measurement of the ambient pressure $p_U$ is expedient during the revolutions of the crankshaft 7 during which combustion does not yet take place.

Figure 5:
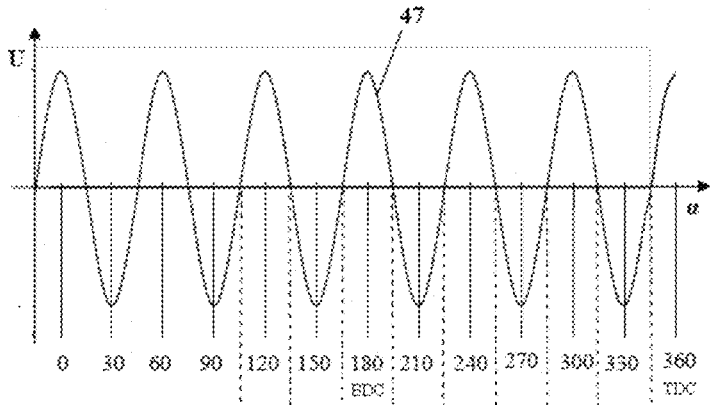
FIG. 5 shows an exemplary profile of the generator signal plotted against the crankshaft angle.

FIG. 5 shows the profile of the generator signal 47 as a voltage U plotted against the crankshaft angle α. The generator 24 has six pole pairs. The generator signal 47 has six sinusoidal waves during one revolution of the crankshaft 7. The generator signal 47 has a total of twelve zero crossings during one revolution of the crankshaft 7. Depending on the mounting of the generator 24 on the crankshaft 7, the zero crossings of the generator signal 47 can be rotated with respect to the actual position of the crankshaft 7 here. In the exemplary embodiment of the figure, the generator signal 47 is shifted by a crankshaft angle α of 15° with respect to the rotational position of the crankshaft 7, with the result that the zero crossings do not occur at a crankshaft angle α of 30° and a multiple thereof but instead in each case 15° crankshaft angle α later.

Figure 6:
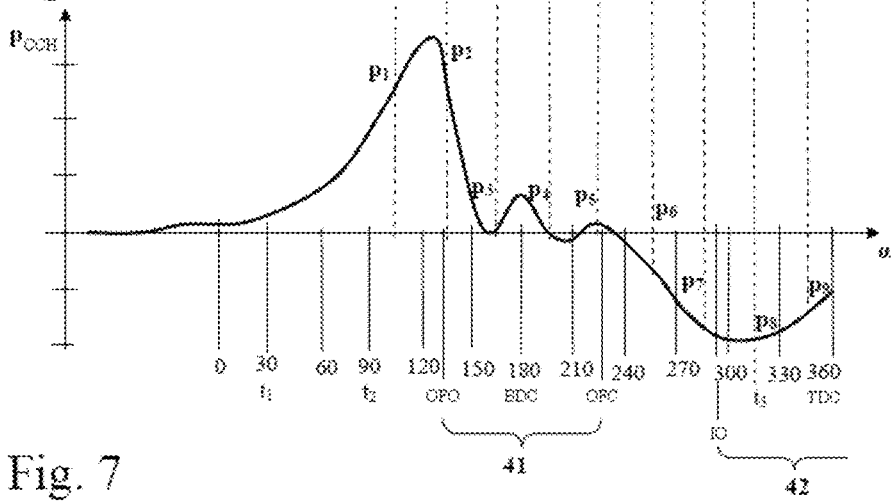
FIG. 6 shows an enlarged illustration of an exemplary profile of the crank casing pressure during the first revolution of the crankshaft.

FIG. 6 shows the pressure profile during the second revolution U2 of the crankshaft 7 after the starting. At the time $t_1$, which can correspond, for example, to a crankshaft angle α of 30°, the energy management of the evaluation device 23 starts. The energy is firstly made available to the evaluation device 23. In the exemplary embodiment of the figure, at the time $t_2$ there is sufficient energy available to activate a microprocessor of the evaluation device 23. At the following zero crossing of the generator signal 47, the crank casing pressure $p_{CCH}$ is measured for the first time. The measured pressure value $p_1$ is stored in the evaluation device 23. The crank casing pressure $p_{CCH}$ is also measured at every following zero crossing of the generator signal 47. The measured pressure values $p_2$ to $p_9$ are likewise stored in the evaluation device 23. The measured pressure values $p_1$ to $p_9$ are evaluated by the evaluation device.

Figure 7:
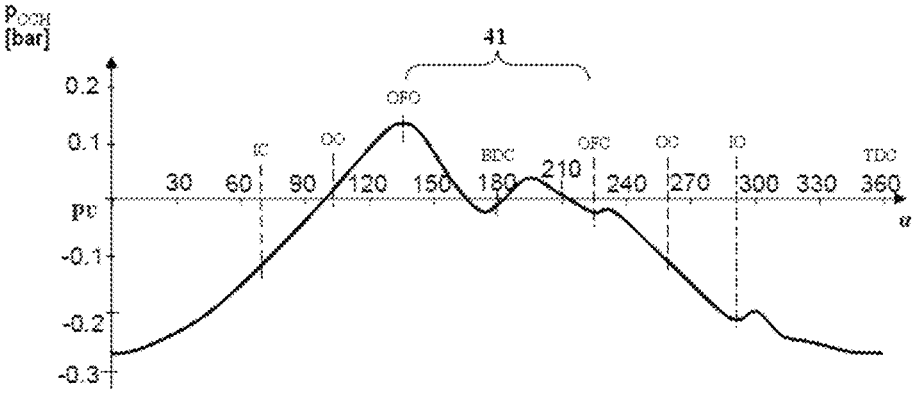
FIG. 7 shows an exemplary schematic illustration of the profile of the crank casing pressure during operation of the internal combustion engine.

FIG. 7 shows the profile of the crank casing pressure $p_{CCH}$ during idling. During idling, ambient pressure $p_U$ prevails in the region of the bottom dead center BDC in the interior 4 of the crank casing. The ambient pressure $p_U$ prevails in the first crank casing angle range 41 in a region from approximately 150° crankshaft angle α up to the closing of the overflow windows 12 at the time OFC. As a result, during idling the ambient pressure $p_U$ can also be determined by means of the crank casing pressure sensor 21. The ambient pressure $p_U$ can be determined from the measurement of the crank casing pressure more precisely when more revolutions of the crankshaft 7 have passed $p_{CCH}$ since the last combustion in the combustion chamber 3. Directly after a combustion has taken place in the combustion chamber 3, the pressure level in the interior 4 of the crank casing is heavily influenced by the combustion. In order to reduce this influence, it is expedient to carry out the pressure measurement in the crank casing 8 after two or more revolutions of the crankshaft 7 have taken place without combustion occurring in the combustion chamber 3. In order to determine the ambient pressure $p_U$ as precisely as possible, it is possible to provide for the determined pressure value to be averaged over a plurality of engine cycles, that is to say over a plurality of revolutions of the crankshaft 7 in the case of a two-stroke engine.

Figure 8:
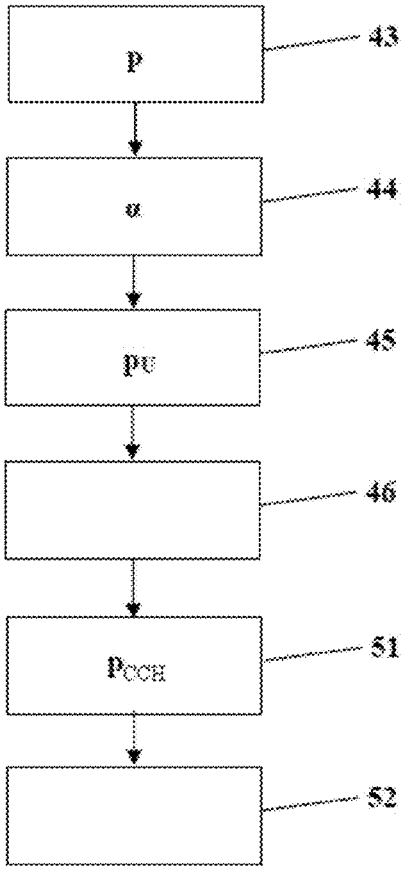
FIG. 8 is a diagram showing one exemplary embodiment of the sequence of the method of the application.

FIG. 8 shows the sequence of the method. In the method step 43, a pressure value $p_1$ to $p_9$ is measured as soon as sufficient energy is available for the pressure measurement, that is to say starting from the time $t_2$, at every zero crossing of the generator signal 47, and is buffered in the evaluation device 23. In the method step 44, the approximate rotational position of the crankshaft 7 is determined, for example, with a crankshaft angle sensor or on the basis of the profile of the generator signal 47. The rotational position of the crankshaft 7 need not be determined precisely. Accuracy of, for example, approximately 30° crankshaft angle may be sufficient for the determination of the ambient pressure $p_U$.

In the method step 45, a pressure value from the buffered pressure values $p_1$ to $p_9$ is selected in the first crankshaft angle range 41 or in the second crankshaft angle range 42 which corresponds to the ambient pressure $p_U$. In the exemplary embodiment, the pressure values $p_3$, $p_4$ and $p_5$ are in the first crankshaft angle range 41. Advantageously, the pressure value $p_3$, that is to say the pressure value which is measured approximately when the bottom dead center BDC is reached, is selected. The second crankshaft angle range 42 can alternatively be selected in order to determine the ambient pressure $p_U$. Here, a pressure value is advantageously selected which has been determined after the top dead center TDC of the piston 5, that is to say during the fourth revolution U4 of the crankshaft 7 (FIG. 4). In the crankshaft angle range 42, the inlet opening 9 is opened and the overflow windows 12 are closed, with the result that the interior 4 of the crank casing is connected to the surroundings only via the inlet opening 9 and the air filter 17. In particular, the pressure values which are measured toward the end of the second crankshaft angle range 42 correspond approximately to the ambient pressure $p_U$. A setpoint volumetric efficiency of the internal combustion engine 1 at full load is advantageously determined on the basis of a characteristic curve. The determined ambient pressure $p_U$ is advantageously utilized here during the selection of a characteristic curve for the setpoint volumetric efficiency. By taking into account the ambient pressure $p_U$, the influence of the altitude at which the internal combustion engine 10 is being operated can be partially or completely compensated for. The volumetric efficiency is the combustion air mass which the internal combustion engine 1 requires per time unit, that is to say the combustion air mass flowing through the combustion chamber 3 with respect to the time. During the determination of the setpoint volumetric efficiency, the ambient temperature may advantageously be taken into account in addition to or as an alternative to taking into account the altitude, and may be at least partially, in particular largely, compensated for.

In the method step 46, the internal combustion engine 1 is controlled in accordance with the determined ambient pressure $p_U$.

In the method step 51, it is determined whether a full load state is present, for example on the basis of the signal of the throttle sensor 15. If a full load state is present, the crank casing pressure $p_{CCH}$ is measured, and the actual volumetric efficiency, that is to say the actual volumetric efficiency of the internal combustion engine 1, is determined from the crank casing pressure $p_{CCH}$, for example by utilizing a characteristic diagram or a calculation.

In the method step 51, the setpoint volumetric efficiency and the actual volumetric efficiency are compared, and the degree of contamination of the air filter 17 is concluded from the difference. If the actual volumetric efficiency is greater than the setpoint volumetric efficiency, no air filter is present. The degree of contamination of the air filter 17 can be displayed to the operator or can be stored for outputting during later maintenance, for example maintenance of the cut-off grinder 30. The absence of an air filter 17 can also be displayed to the operator. It is also possible to provide for the operator to be given feedback about the state of the air filter 17 by means of the behavior of the internal combustion engine 1, for example by reducing the power of the internal combustion engine 1 or by switching off the internal combustion engine 1.

In order to determine the degree of contamination of the air filter 17, the crank casing pressure $p_{CCH}$ is measured at full load in the method step 51. The pressure measurement advantageously always takes place at the same crankshaft angle $\alpha$, for example approximately at the bottom dead center BDC, that is to say at a crankshaft angle $\alpha$ of approximately 180°. The degree of contamination of the air filter 17 can be determined from the ratio of the value for the crank casing pressure $p_{CCH}$, measured during starting, for example at the bottom dead center BDC, which value corresponds approximately to the ambient pressure $p_U$, and the value for the crank casing pressure $p_{CCH}$, which value is measured at full load at a predefined crankshaft angle $\alpha$, for example likewise at the bottom dead center BDC. The determined pressure ratio is advantageously compared with a permissible value. Alternatively, the pressure difference between the ambient pressure $p_U$ and the crank casing pressure $p_{CCH}$ can be determined at full load. Another evaluation of the pressure values, in particular a calculation or the evaluation of the actual volumetric efficiency and the setpoint volumetric efficiency described with respect to FIG. 8, can also be advantageous for determining the degree of contamination of the air filter 17. If excessive contamination of the air filter 17 is detected, it is advantageously displayed to the operator via the display 40 that the air filter 17 should be cleaned.

It may be advantageous for the internal combustion engine 1 to have an energy source such as, for example, a battery, an accumulator or the like, which already makes energy available before the internal combustion engine 1 starts. In the case of a tool in which energy is already available before the crankshaft 7 of the internal combustion engine 1 begins to turn, a pressure value can already be measured in the crank casing before the internal combustion engine 1 starts, that is to say before the crankshaft 7 turns. Before the starting, ambient pressure advantageously prevails in the interior 4 of the crank casing, and the ambient pressure $p_U$ can therefore be measured directly in the interior 4 of the crank casing before the internal combustion engine 1 starts.

The foregoing description of preferred embodiments has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

The invention claimed is:

1. A method for operating an internal combustion engine, the method comprising:

providing a crank casing pressure sensor in an internal combustion engine having a crank casing, measuring a crank casing pressure using the crank casing pressure sensor, evaluating the crank casing pressure measurement, using the crank casing pressure measurement to determine an approximate ambient pressure value, and controlling the internal combustion engine, a component thereof, or a device attached to the internal combustion engine using the crank casing pressure measurement or the approximate ambient pressure value or both, wherein the crank casing pressure is measured at a time at which approximately ambient pressure prevails in the crank casing.

2. The method according to claim 1, further comprising:

measuring an angle of rotation of a crankshaft, evaluating the angle of rotation measurement, and controlling the internal combustion engine, a component thereof, or a device attached to the internal combustion engine using the angle of rotation measurement.

3. The method according to claim 1, wherein the internal combustion engine comprises:

a combustion chamber bounded on one side and around a circumference by a cylinder and bounded on the other side by a reciprocating piston, a crankshaft driven by the reciprocating piston which is rotatably mounted in the crank casing, an inlet opening in the crank casing which allows combustion air to enter into the crank casing, an outlet opening out of the combustion chamber, and one or more overflow ducts connecting the crank casing to the combustion chamber in the region of the bottom dead center of the piston.

4. The method according to claim 3, wherein the crank casing pressure is measured during the starting process of the internal combustion engine before the first combustion as the crankshaft is rotating.

5. The method according to claim 3, wherein the crank casing pressure is measured in a first crankshaft angle range in which the inlet opening is closed and the crank casing is connected to the combustion chamber via one or more overflow ducts, and in which the outlet opening is open.

6. The method according to claim 3, wherein the crank casing pressure is measured in a second crankshaft angle range in which the inlet opening is open.

7. The method according to claim 3, wherein the internal combustion engine has a generator, and the crank casing pressure sensor measures the crank casing pressure at each zero crossing of the generator signal to produce crank casing pressure values, and the crank casing pressure values are buffered.

8. The method according to claim 7, wherein the approximate rotational position of the crankshaft is determined, and a measured value, which has been measured in the desired crankshaft angle range, is selected from the buffered crank casing pressure values on the basis of the determined rotational position of the crankshaft.

9. A method for operating an internal combustion engine, the method comprising:

providing a crank casing pressure sensor in an internal combustion engine having a crank casing, measuring a crank casing pressure using the crank casing pressure sensor, evaluating the crank casing pressure measurement, using the crank casing pressure measurement to determine an approximate ambient pressure value, and controlling the internal combustion engine, a component thereof, or a device attached to the internal combustion engine using the crank casing pressure measurement or the approximate ambient pressure value or both, wherein the crank casing pressure is measured during the starting process of the internal combustion engine before the first combustion as the crankshaft is rotating, wherein the crank casing pressure sensor is exclusively supplied with energy generated by the movement of the crankshaft during while the crank casing pressure sensor takes the crank casing pressure measurement, and wherein the internal combustion engine comprises:

a combustion chamber bounded on one side and around a circumference by a cylinder and bounded on the other side by a reciprocating piston, a crankshaft driven by the reciprocating piston which is rotatably mounted in the crank casing, an inlet opening in the crank casing which allows combustion air to enter into the crank casing, an outlet opening out of the combustion chamber, and one or more overflow ducts connecting the crank casing to the combustion chamber in the region of the bottom dead center of the piston.

10. The method according to claim 9, wherein the crank casing pressure is measured as soon as the crank casing pressure sensor is supplied with sufficient energy for the crank casing pressure sensor to take the crank casing pressure measurement.

11. The method according to claim 9, wherein the crank casing pressure is measured at a time at which approximately ambient pressure prevails in the crank casing.

12. A method for operating an internal combustion engine, the method comprising:

providing a crank casing pressure sensor in an internal combustion engine having a crank casing, measuring a crank casing pressure using the crank casing pressure sensor, evaluating the crank casing pressure measurement, using the crank casing pressure measurement to determine an approximate ambient pressure value, and controlling the internal combustion engine, a component thereof, or a device attached to the internal combustion engine using the crank casing pressure measurement or the approximate ambient pressure value or both, wherein the internal combustion engine has an air filter through which the combustion air is sucked in, and a degree of contamination of the air filter is determined from the approximate ambient pressure value, and wherein the internal combustion engine comprises:

a combustion chamber bounded on one side and around a circumference by a cylinder and bounded on the other side by a reciprocating piston, a crankshaft driven by the reciprocating piston which is rotatably mounted in the crank casing, an inlet opening in the crank casing which allows combustion air to enter into the crank casing, an outlet opening out of the combustion chamber, and one or more overflow ducts connecting the crank casing to the combustion chamber in the region of the bottom dead center of the piston.

13. The method according to claim 12, wherein the crank casing pressure is measured at full load of the internal combustion engine, and the degree of contamination of the air filter is determined from the approximate ambient pressure value and the crank casing pressure at full load.

14. The method according to claim 13, wherein a setpoint volumetric efficiency of the internal combustion engine is determined at full load, an actual volumetric efficiency of the internal combustion engine at full load is determined from the crank casing pressure at full load, and the degree of contamination of the air filter is determined from the difference between the actual volumetric efficiency and the setpoint volumetric efficiency.

* * * * *